US005630408A

United States Patent [19]

Versluis

[11] Patent Number: 5,630,408

[45] Date of Patent: May 20, 1997

[54] GAS/AIR RATIO CONTROL APPARATUS FOR A TEMPERATURE CONTROL LOOP FOR GAS APPLIANCES

[75] Inventor: Marius Versluis, Tavistock, England

[73] Assignee: Ranco Incorporated of Delaware, Wilmington, Del.

[21] Appl. No.: 250,277

[22] Filed: May 27, 1994

[30] Foreign Application Priority Data

May 28, 1993 [DE] Germany ..... 43 17 981.9

[51] Int. Cl.[6] ..... F24H 1/10

[52] U.S. Cl. ..... 126/351; 431/90; 431/12; 431/18; 431/75; 431/80

[58] Field of Search ..... 431/12, 18, 89, 431/90, 75, 80; 126/351

[56] References Cited

U.S. PATENT DOCUMENTS

| | | | |
|---|---|---|---|
| 3,299,940 | 1/1967 | Phillips et al. | 431/90 |
| 4,104,016 | 8/1978 | Baysinger | 431/69 X |
| 4,436,506 | 3/1984 | Berkhof | 431/12 X |
| 4,913,128 | 4/1990 | Adachi | 431/12 X |

FOREIGN PATENT DOCUMENTS

| | | | |
|---|---|---|---|
| 0108349 | 10/1983 | European Pat. Off. . | |
| 0450173 | 12/1990 | European Pat. Off. . | |
| 0450173 | 10/1991 | European Pat. Off. | 431/12 |
| 0614046A1 | 9/1993 | European Pat. Off. . | |
| 2483051 | 3/1981 | France . | |
| 3010737 | 9/1981 | Germany | 431/90 |
| 0024140 | 3/1978 | Japan | 431/90 |
| 0224226 | 12/1983 | Japan | 431/12 |
| 0224228 | 12/1983 | Japan | 431/12 |
| 0165419 | 8/1985 | Japan | 431/90 |
| 3055424 | 3/1991 | Japan | 431/12 |
| 1405093 | 7/1975 | United Kingdom | 431/90 |
| 2018970 | 10/1979 | United Kingdom . | |
| 2075718 | 11/1981 | United Kingdom . | |
| 2079924 | 1/1982 | United Kingdom | 431/90 |

OTHER PUBLICATIONS

EPO Search Report (No Date).

Translations of EPO Patent Appln. Nos. 0 108 349 and 0 450 173 A1 (No Date).

"SIT 828 Novamix" Product Brochure, SIT Group, pp. 1–8 (No Date).

"Gas–Air Ratio Control System for Optimum Boiler Efficiency" Publication, Honeywell Combustion Controls Center, pp. 1–4. (No date).

"Gas Air Ratio Module" Product Brochure, Honeywell Combustion Controls Center, pp. 1–6 (No Date).

*Primary Examiner*—Carl D. Price

*Attorney, Agent, or Firm*—Watts, Hoffmann, Fisher & Heinke

[57] ABSTRACT

The invention relates to a gas/air ratio control apparatus for a temperature control loop for household gas appliances, in particular for domestic/direct hot water units and combined direct hot water/central heating units, for temperature control of domestic and/or heating water. The invention is particularly suitable for household appliances up to 120 KW. The gas/air ratio control apparatus comprises a controllable fan (3) for supplying a predetermined air stream (2-2) to a burner (4) in dependence on the detected actual temperature ($T_{Actual}$) and the desired target temperature ($T_{Target}$) of the heating and/or domestic hot water; and a pressure-controllable valve (8) for controlling the supply of a specified fuel quantity (1) to the burner (4) in dependency exclusively on the absolute pressure of the air stream (2-2) produced by the controllable fan (3). The inventive temperature control apparatus operates in an air/fuel regulating range of 20% to 100%, the controllable valve (8) supplying a fuel quantity (1) to the burner (4) having a pressure at a ratio of 1:1 to the absolute pressure of the air stream (2-2) produced by the controllable fan (3). The system uses only one pressure sensing line (11) and can always be brought into a safe condition when faults appear in the burner (4).

17 Claims, 5 Drawing Sheets

GAS/AIR RATIO CONTROL APPARATUS FOR A TEMPERATURE CONTROL LOOP FOR GAS APPLIANCES

FIELD OF THE INVENTION

The invention relates to a gas/air ratio control apparatus for a temperature control loop for gas appliances, in particular for domestic water appliances and combined domestic water/central heating systems for the temperature control of domestic and/or heating water. The invention is particularly suitable for gas appliances for domestic devices up to 120 KW.

BACKGROUND ART

In industrial as well as domestic use, temperature control of domestic and/or heating water is very important. For example, a main boiler provided in many households for the central heating system is heated by a burner. A fuel/air mixture is fed to the boiler and the heat it generates is transferred to the main boiler via a heat exchanger. The supplied fuel can be gas. The firing-on and -off times for the heating boiler can be manually set with a timer so that heating water with a specified temperature can be made available for example in the morning and early evening. The boiler is well insulated, but as soon as the temperature of the burner boiler drops below a specified threshold value temperature, the burner is switched on via a simple on/off switching mechanism in order to increase the water temperature within the heating boiler. When the temperature of the boiler water has reached the predetermined and adjustable threshold temperature, an automatic switching off of the burner is effected.

In this heating system, temperature control takes place by means of an on/off control of the burner, which means that either the temperature of the water from the heating boiler is monitored and used for control of the on/off times of the burner, or the control of the on/off times is carried out via a detector mounted in a room to maintain the room temperature constant.

In such known heating systems, however, it is conceivable that the air/fuel mixture supply to the burner is controlled to such an extent that as few harmful substances as possible result from the combustion.

On the other hand, flow heaters are known for domestic water supply in which the application of a large quantity of energy to a small through-flow area in a domestic water supply line results in heating of domestic water when this goes through the supply line. These often include electrical flow heaters which use electrical heating coils for heating. In these, control does not normally ensue by means of the temperature of the domestic water, rather the predetermination of the temperature effects the control for the heating spools to feed a quantity of electrical energy corresponding to the predetermined target temperature.

For domestic water/central heating systems in the household, fuel/air mixture control systems are known for achieving an optimum boiler efficiency, as for example the "Gas-Air Ratio Control System for Optimum Boiler Efficency" described in the product information of Honeywell. Such a control system is shown in FIG. 4. This fuel/air mixture control system was especially developed to meet the requirements of clean and efficient use of heating boilers in the domestic area. Such a system makes control of the boiler efficiency possible over the entire operational range. In particular, it makes it possible to use energy always with the highest efficiency. It is also possible in such a system to provide a constant $CO_2$ control or to control the $CO_2$ values in the exhaust gas proportionally to the load. In FIG. 4, reference sign 16 denotes an air inlet to the burner, 17 a fuel inlet to the burner, 18 a differential pressure or Venturi valve, 2-2 a supplied air stream and 19 a consumer.

In this control system the direct gas flow to the burner is determined by the value of the differential pressure at the Venturi valve arrangement. The Venturi valve arrangement controls the outlet pressure proportionally to the differential pressure. Thus, the gas outlet pressure is controlled as a function of the differential pressure via a Venturi arrangement which is located in an air supply line. A special device transforms the detected air pressure difference into a gas outlet pressure. As FIG. 5 shows, this occurs at a pressure ratio of approximately 1 to 8. Additionally, this known system requires two pressure sensing lines 11-1, 11-2 and a transducer 11-3 for fuel/air control. The main function of the control system for a gas/air mixture shown in FIGS. 4 and 5 is to control the efficiency of the burner via the adjustable input load so that the harmful substances in the generated combustion gases do not exceed a preset value.

However, in a domestic water supply, the temperature of the water drawn from the boiler must be determined, i.e. a control of the gas/air mixture must be carried out in such a manner that the temperature of the water fed to a tap etc. is maintained constant. When little water is drawn off, only a small air/gas mixture must be supplied, whereas a large air/gas mixture must be supplied when a large quantity of water is used. This control must therefore operate in a wide modulation range for the air/gas mixture.

However, the air flow must be maintained constant for the gas modulation. A thermistor sensor can be arranged in the supply to the consumer and a potentiometer can be simplified in order to regulate the predetermined water temperature.

However, on account of the use of a Venturi valve arrangement, only modulation levels of the gas/air mixture in the range of typically 45% to 100% can be achieved. Thus, such a system is not suitable for temperature control for a domestic water supply which must cover a far greater temperature or modulation range. Additionally, such a system is of the on/off type so that an additional water mixing valve must be provided for the domestic water supply.

In addition to the disadvantage described above of not being able to control the domestic water supply and the fact that the shown arrangement is costly on account of the components used, strict safety requirements must obviously be met by such burner systems. This is especially important for the mass production of such control systems, as one can not expect that special safety precautions are always taken in mounting such control systems in many households. However, when a control system shown in FIGS. 4 and 5 is used, dangerous conditions can arise, as described in the following, i.e. the system does not have a fail-safe operation. This is so because the system uses two pressure sensing lines 11-1, 11-2 which monitor the differential, pressure of the air flow in the Venturi valve arrangement in the air supply line 16. If the pressure sensing line with low pressure, i.e. the downstream pressure sensing line has a leakage or is broken, the gas control valve is nevertheless opened on account of the incorrectly detected pressure difference and an increased gas supply to the burner is consequently effected. This excessive gas flow to the burner produces undesirable carbon monoxide on account of the insufficient air supply. This can cause a dangerous condition in the burner.

Additionally, the shown system is not cost effective. The system uses a transducer 11-3 for the control of the gas/air mixture which maintains the pressure ratio of 1 to 8 described above. The additional provision of a servo-regulator 11-4 thus increases the costs for the gas control.

Further, the influence of changes in ambient pressure can not be compensated for with the shown control system. For the servo-regulator 11-4 to be free of variations in ambient pressure, a combustion pressure compensation connection to the air-side (vent hole) of the gas control must be provided.

Summarizing, the above-described control systems for temperature control of burners have the following disadvantages:

a) The Venturi-valve arrangement controls at a ratio of differential pressure to burner pressure of 1:8;

b) the air/fuel mixture can not be controlled in the range of 20% to 100% required for domestic water temperature control;

c) a fail-safe operation can not be guaranteed;

d) the number of required components is large and the control systems are therefore not cost-effective; and e) the control systems are dependent on ambient pressure variations.

It is therefore the object of the invention to provide a gas/air ratio control apparatus for a temperature control loop for gas appliances which enables control of the air/fuel mixture fed to a burner for a temperature range required for a domestic water supply, is cheap and allows fail-safe operation.

DISCLOSURE OF THE INVENTION

This object is solved by a gas/air ratio control apparatus for a temperature control loop for gas appliances for domestic devices, in particular for domestic water systems and combined hot water/central heating systems for temperature control of domestic water and/or heating water which is characterized by:

a) a controllable fan for supplying a predetermined air stream to the burner in dependence on a detected actual temperature and a desired target temperature of the heating and/or domestic water;

b) a pressure-controllable valve for controlling the supply of a specified fuel quantity to a burner exclusively in dependence on the absolute pressure of the air stream produced by the controllable fan;

c) a pressure sensing line for transferring the absolute pressure of the air stream produced by the controllable fan to a control connection of the controllable valve; and d) two supply lines for the respective supply of the air stream and the fuel quantity to the burner with a nozzle arranged in the fuel supply line and a restriction arranged in the air supply line.

The gas/air ratio control apparatus according to the invention has a number of substantial advantages in comparison to the known control apparatus. In particular, the gas/air ratio control device uses a controllable fan for supplying a predetermined air stream to the burner and a valve controllable via the pressure which is exclusively controlled by the absolute pressure of the air stream produced by the controllable fan. As the absolute air pressure is taken from the controllable fan, regulation is carried out at a fuel/air mixture of 1:1. Thus, a fuel/air modulation range of 20% to 100% can be advantageously achieved. Consequently, in accordance with the invention, a valve is used which can be controlled via the direct pressure of the air stream generated by the fan so that no differential pressure must be detected, as was the case in the state of the art. Temperature control in heating domestic water in domestic appliances is therefore possible with the wide modulation range. The fuel/air mixture to the burner is modulated by the fuel volume and the air volume instead of by means of the fuel and air pressures. Additionally, the oxygen level in the combustion gases is maintained constant with the inventive control apparatus and at up to 1% in a fuel/air modulation range of 20% to 100%. Further, a fail-safe operation is advantageously guaranteed in the inventive gas/air ratio control apparatus, as the controllable valve is controlled via only one pressure sensing line by the absolute pressure of the air stream produced by the controllable fan.

The controllable fan can be regulated by a measuring device which has a thermistor or a PTC-resistor provided in the piping system for supplying the domestic and/or heating water to a domestic water supply appliance. The measuring device generates a measurement voltage in accordance with the detected actual temperature of the domestic and/or heating water, wherein a temperature setting device includes an adjustable potentiometer and supplies a control voltage corresponding to the desired target temperature. It is advantageous to design the controllable fan such that it is controllable by a voltage, namely the voltage difference between the control voltage and the measured voltage.

The burner has two lines for the supply of the air and the fuel, wherein it is advantageous to provide a nozzle in the fuel supply line and a restriction in the air supply line. In this way, the fuel pressure in the fuel supply line or the air pressure in the air supply line can be transformed into a specified volume flow.

Gas is used as a fuel for the burner.

Advantageously, the controllable fan is arranged in the air supply line to the burner so that the burner directly receives the air stream produced by the controllable fan via the air supply line.

To exhaust the combustion gases produced during combustion of the fuel/air mixture, the burner and the heat exchanger are preferably provided in a common housing, the housing having an exhaust gas outlet.

Advantageously, the controllable valve has an inlet connection, an outlet connection and a control connection which together with the fuel line that provides fuel at a constant pressure are connected with the fuel supply line to the burner and with the air supply line to the burner by a pressure sensing line. The considerable advantage of such a design of the controllable valve is that only one pressure sensing line must be connected with the air supply line, i.e. only a single pressure sensing line must be provided for modulating the fuel/air mixture. Although the pressure sensing line can detect any pressure in the air supply line, it is particularly advantageous to connect the pressure sensing line in such a manner with the air supply line to the burner that it transfers the absolute pressure of the air stream produced by the controllable fan to the control connection of the controllable valve.

The controllable valve is advantageously designed such that the pressure at its outlet connection respectively follows the pressure at its control connection i.e. when the pressure at the control connection increases, the pressure at its outlet connection increases, whereas the outlet pressure is reduced in response to a pressure drop at the control connection. When the fuel pressure at the inlet connection supplied via the fuel supply line has a predetermined value, the controllable valve is preferably designed such that it sets a pressure at its outlet connection in response to a control pressure at the control connection which is the same as or less than the fuel supply pressure. It is particularly advantageous to adjust the pressure outlet connection such that it equals the control pressure fed to the control connection. This results in substantial advantages in respect of the fail-safe operation. If a leakage occurs in the pressure sensing line, the pressure of the controllable fan on the control connection of the controllable valve reduces. While the air stream remains constant, only a lower fuel pressure can be set at the fuel supply line for the burner on account of the reducing air pressure at the control connection, on account of which the fuel/air mixture supplied to the burner is reduced to a poor mixture that burns with excessive air, i.e. in a safe condition.

If the pressure sensing line is broken, the pressure produced by the controllable fan can not create pressure at the control connection of the controllable valve so that no fuel is fed to the burner. This also ensures a safe condition of the temperature control apparatus. Even if the pressure sensing line is blocked, the air pressure produced by the controllable fan can not generate any pressure at the control connection of the valve so that no fuel is supplied to the burner.

In both cases, namely when the pressure sensing line is broken or blocked, it is an advantage that no air pressure is generated at the control connection of the controllable valve and that no fuel pressure is therefore generated at the fuel line to the burner so that no fuel flows.

Even if the air inlet from which the controllable fan draws the air is blocked, this results in a reduction in the produced air pressure and thus in the fuel pressure. The reduced fuel/air mixture thus enables the burner to operate a safe burning process.

A different dangerous condition can occur upon blocking of the exhaust gas outlet or dirt collecting in the heat exchanger. In this case, however, the pressure in the burning chamber of the burner will advantageously increase, which itself reduces the pressure drop across the fuel nozzle as well as the air restriction in the air inlet to the burner. On account of the pressure drop, a reduced fuel/air mixture is fed to the burner and the burner thus operates in a safe condition, i.e. it burns with low power.

Advantageously, the gas/air ratio control apparatus can have a safety mechanism for closing two safety valves, the mechanism being coupled with a monitoring device arranged in the burner. This monitoring device can monitor the heat generation in the burner. If a missing flame is detected by the monitoring device, i.e. flame formation is too small, the fuel supply to the burner is interrupted. This can occur particularly in the case of a broken or blocked pressure sensing line if the fuel control leads a safe amount of gas over an internal breather-hole to the burner. However, if this fuel/air mixture is too low to form a flame, the monitoring device will in this case regulate the control mechanism to close the safety valve. The safety mechanism is also actuated by the monitoring device if the air inlet to the controllable fan is blocked. Although it is already guaranteed on account of the controllable valve that the fuel/air mixture is reduced when an extreme blocking of the air inlet or the exhaust gas outlet occurs, it is advantageously ensured in extreme conditions by means of the monitoring device that the fuel supply is interrupted. Thus, the burner always passes into a safe condition.

As the controllable valve is directly controlled by the controllable fan via the absolute air pressure, the controllable valve only has a single control connection and only one pressure sensing line must be provided. Thus, the inventive control apparatus is also cheap.

Furthermore, the inventive control apparatus is not influenced by variations in the ambient pressure as the control connection is part of a closed loop. This closed loop is formed as follows: Control connection of the controllable valve - fuel supply line to the burner - nozzle - burner - air restriction - air supply line - pressure sensing line. Thus, changes in the ambient pressure can not influence the setting of the control apparatus.

When such a gas/air ratio control apparatus is used in a temperature control loop in which a fuel/air mixture is to be supplied to a burner, a wide fuel/air modulation range of 20% to 100% is obtained. The advantage of this wide modulation range is that the temperature control loop with the inventive control apparatus can be used for temperature control of domestic, i.e. direct hot water. As a simple control valve is used and, on account of this, only one pressure sensing line must be provided, the control apparatus is cheap and suitable for use in controlling domestic water and heating water in water heating devices and combi boilers. This is particularly advantageous for boiler manufactures both with respect to the numerous possibilities for use and the cheap design. In any case, the inventive control apparatus is cheaper than a commonly known version of the regulator with a modulation spool which is used for hot water temperature control, electronic components having to be simultaneously provided in order to drive the modulation coil.

Further advantageous embodiments of the inventive control apparatus are defined in the dependent claims.

BRIEF DESCRIPTION OF THE DRAWINGS

In the following the invention is described in more detail by way of a preferred embodiment with reference to the drawing, in which.

BEST MODE FOR PRACTICING THE INVENTION

Figure 1:
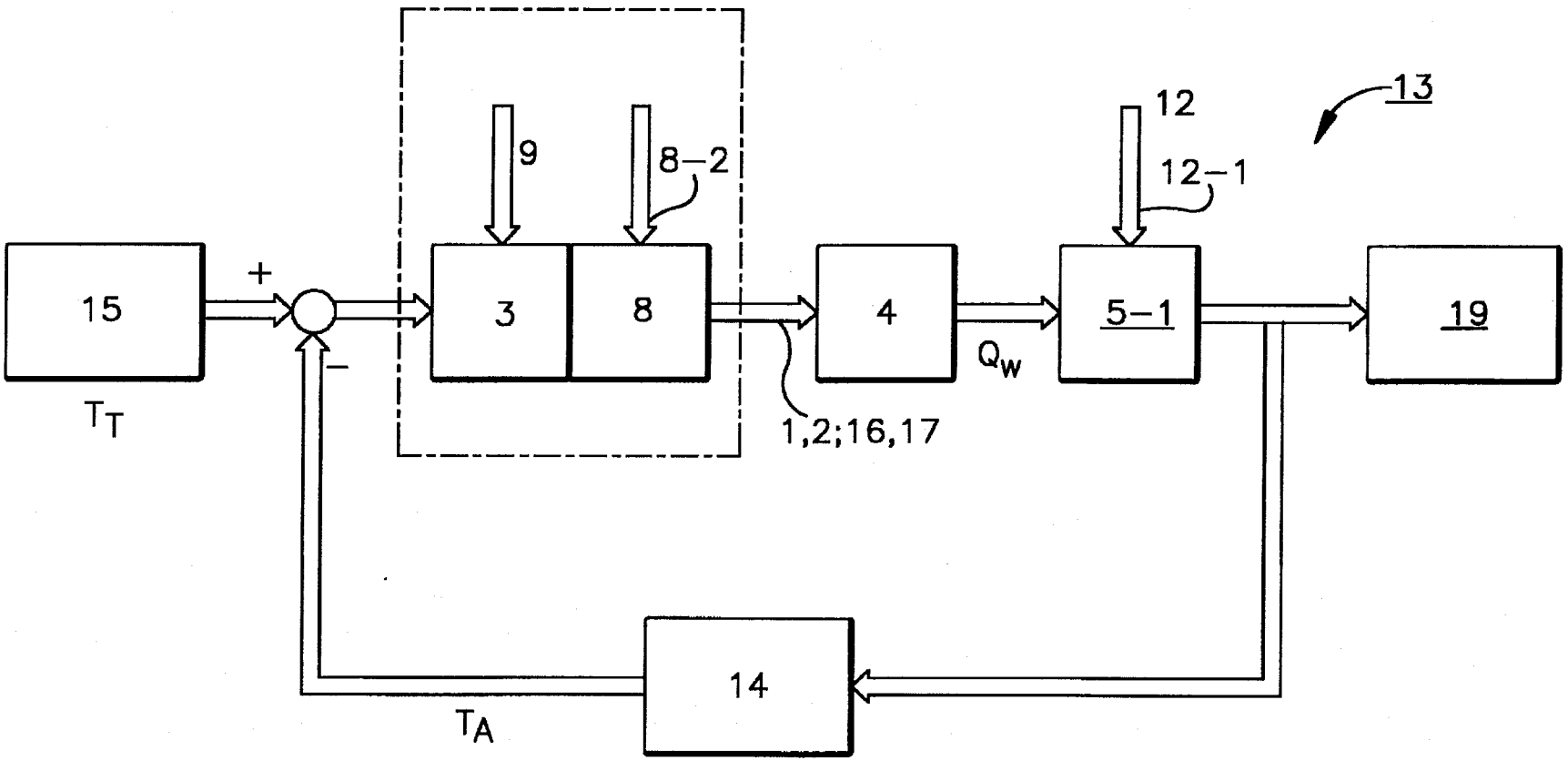
FIG. 1 shows a block diagram of the inventive temperature control loop and the inventive gas/air ratio control apparatus.

FIG. 1 shows the temperature control loop for the temperature control of domestic and/or heating water with an inventive gas/air ratio control apparatus. In the temperature control loop shown in FIG. 1, a fixed value control is carried out in such a manner that the temperature of domestic and/or heating water flowing in a piping system 13 to a consumer 19 is maintained at a constant target temperature $T_{Target}$ preset by a temperature setting device 15. In the depicted control loop, a control path in the form of a boiler 5-1 is supplied with cold water 12 via a pipeline 12-1, the water being heated by a quantity of heat $Q_W$ produced by a control device.

The control device which produces the preset quantity of heat $Q_W$ for heating the heating and/or domestic water to the desired target temperature $T_{Target}$ includes a measuring device 14 for determining the actual temperature $T_{Actual}$ of the water flowing out of the boiler 5-1, an actuator in the form of a burner 4, 5-3 which produces a quantity of heat in dependence on a supplied fuel/air mixture 1, 2; 16, 17 and a regulator 3, 8, 9, 8-2 for supplying the air-fuel mixture to the burner.

The gas/air ratio control apparatus consists of a controllable fan 3 which draws in air via an air inlet 9 and a controllable valve 8 which receives the fuel from a fuel supply line (not shown). The controllable valve is designed such that it is directly and exclusively controlled by the absolute air pressure of the air stream from the controllable fan. The gas/air ratio control apparatus, i.e. the control apparatus, is designed such that even when a large domestic or hot water volume flow to several consumers 19 such as a bath tub, a shower, rinsing water etc. simultaneously occurs, the hot water flowing to these consumers is maintained at the preset temperature $T_{Target}$. The fuel/air mixture is regulated within a wipe modulation range of 20% to 100% in accordance with the set temperature and the temperature of the hot water delivered to the consumers. The temperature control apparatus designed in this manner is suitable for use in all household gas burning appliances which use pre-mix burners, the input of which should not exceed 120 kW, for example gas central heating boilers, gas water heaters, combined gas central heating boilers/water heaters and combi boilers.

Figure 2:
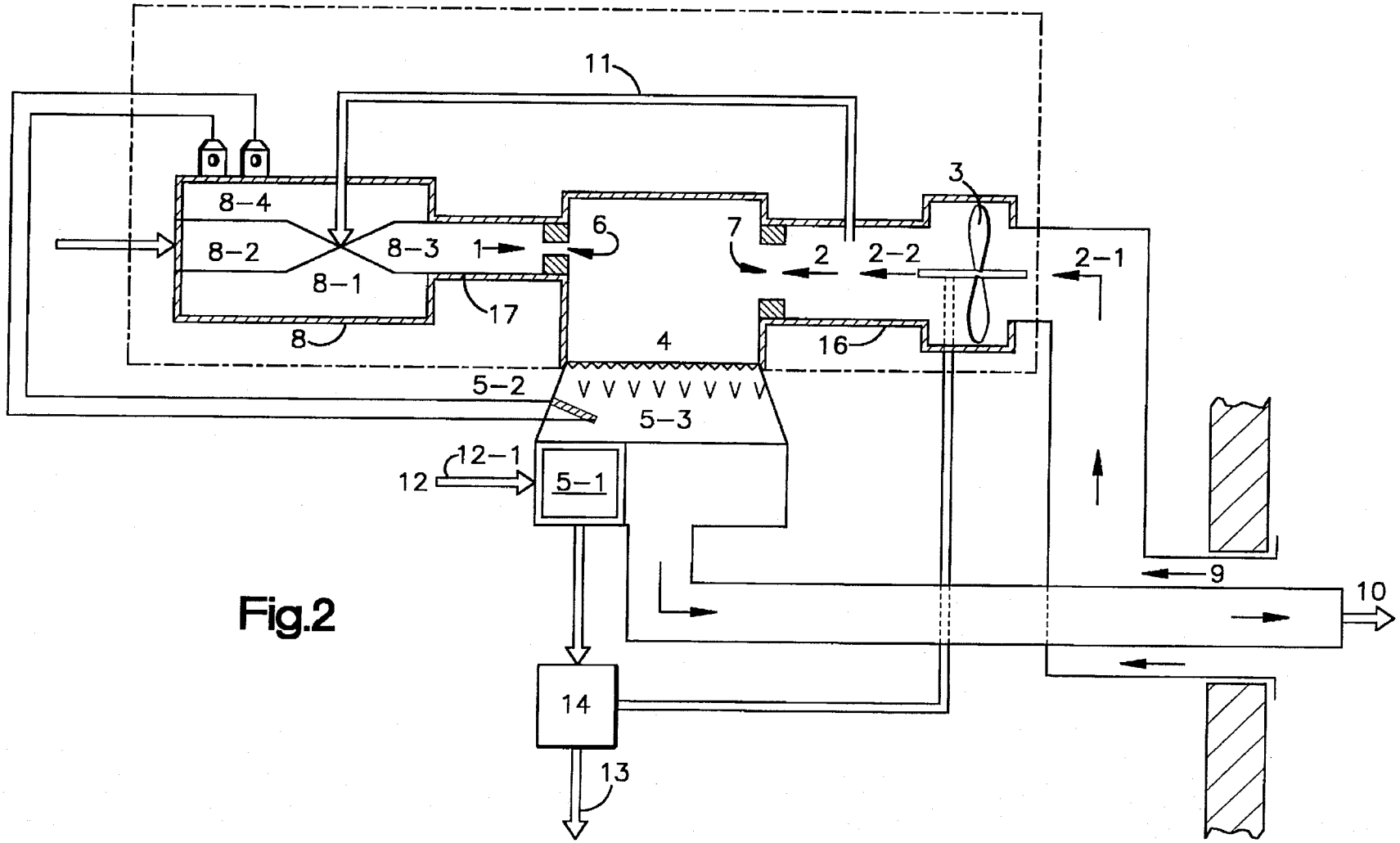
FIG. 2 shows an embodiment of the temperature control loop shown in FIG. 1 and of the inventive gas/air ratio control apparatus.

A practical embodiment of the temperature control loop shown in FIG. 1 can be seen in FIG. 2. The corresponding reference signs in FIG. 2 represent the same parts as in FIG. 1. In particular, FIG. 2 shows an air inlet 9 via which a controllable fan 3 draws in inlet air 2-1 and sends an air stream 2-2 with a predetermined pressure through an air supply line 16 to the burner 4. A restriction 7 is provided in the air supply line. On the other side, the burner 4 receives a predetermined quantity of fuel 1 via a fuel supply line 17 and a nozzle or injector 6 provided in the fuel supply line. The controllable valve 8 is connected at its inlet connection 8-2 with a fuel line, for example a gas pipe. The fuel line provides fuel at a constant pressure. The controllable valve 8 is connected at its outlet connection 8-3 with the fuel supply line 17 in order to lead a fuel quantity 1 adjusted by the control connection 8-1 to the burner 4. A pressure sensing line 11 is connected with the control connection 8-1 of the controllable valve 8 and also connected with the air supply line 16 in such a manner that it exclusively transfers the air pressure of the air stream produced by the controllable ventilator or fan 3. The burner 4 thus burns a fuel/air mixture supplied via the nozzle and the air restriction 7, the quantity of heat $Q_W$ produced in this manner being transferred to a boiler 5-1 via a heat exchanger 5-3. In this manner, cold water 12 supplied to the boiler 5-1 via a piping 12-1 is heated and heated domestic water and/or heating water is supplied to a consumer 10 via an outlet piping system 13. The housing in which the burner 4, the heat exchanger 5-3 and the boiler 5-1 are arranged additionally has an exhaust outlet 10 for removing the exhaust gases produced during combustion. The measuring device already shown in FIG. 1 is a thermistor or PTC-resistor 14 provided in the piping system 13 and detects the actual temperature $T_{Actual}$ of the water flowing in the piping system 13. A voltage drop across the thermistor is supplied to the fan 3 which produces an air stream 2-2 corresponding to the supplied measurement voltage. The temperature setting device shown in FIG. 1 but not in FIG. 2 can additionally be provided between the measuring device 14 and the controllable fan 3. The temperature setting device can in this case be a simple potentiometer, the controllable fan 3 then receiving a differential voltage between the measurement voltage delivered by the thermistor and the voltage delivered by the potentiometer.

Thus, a fuel/air mixture is adjusted in the burner via the control loop in dependency on the volume flow in the piping system 13 in such a manner that the temperature of the discharged water is maintained constant. In the case of an increase in the absolute pressure of the air stream 2-2, fuel is supplied at the outlet connection 8-3 with a pressure which corresponds to the pressure in the pressure sensing line 11. The fuel pressure increases with an increase in the air pressure 2-2, whereas the fuel pressure also drops at the outlet connection 8-3 with a drop in the pressure in the pressure sensing line 11. In particular, the valve 8 is designed such that fuel pressure is adjusted at its outlet connection 8-3 response to the pressure at its control connection 8-1, the fuel pressure being smaller than or equal to the pressure prevailing in the fuel supply line. In particular, a ratio of 1:1 exists between the air pressure acting at the control connection 8-1 and the fuel pressure.

Thus, the fuel/air mixture is adjustable in a modulation range of 20% to 100% in dependency on the temperature $T_{Actual}$ of the water flowing in the piping system 13.

Further, the controllable valve 8 includes a safety mechanism 8-4 which is coupled with a monitoring device 5-2 provided in the burner housing. The safety mechanism 8-4 is provided to close a gas regulating safety valve so that no fuel is supplied to the control connection 8-1. The monitoring device 5-2 is provided to monitor the flame formation in the burner. When the flame formation in the burner 4 is too small despite supply of a fuel/air mixture, the monitoring device generates a control signal in the safety mechanism to close both gas control safety valves of the controllable valve 8. Thus, the monitoring device monitors the heat generation in the burner.

Figure 3:
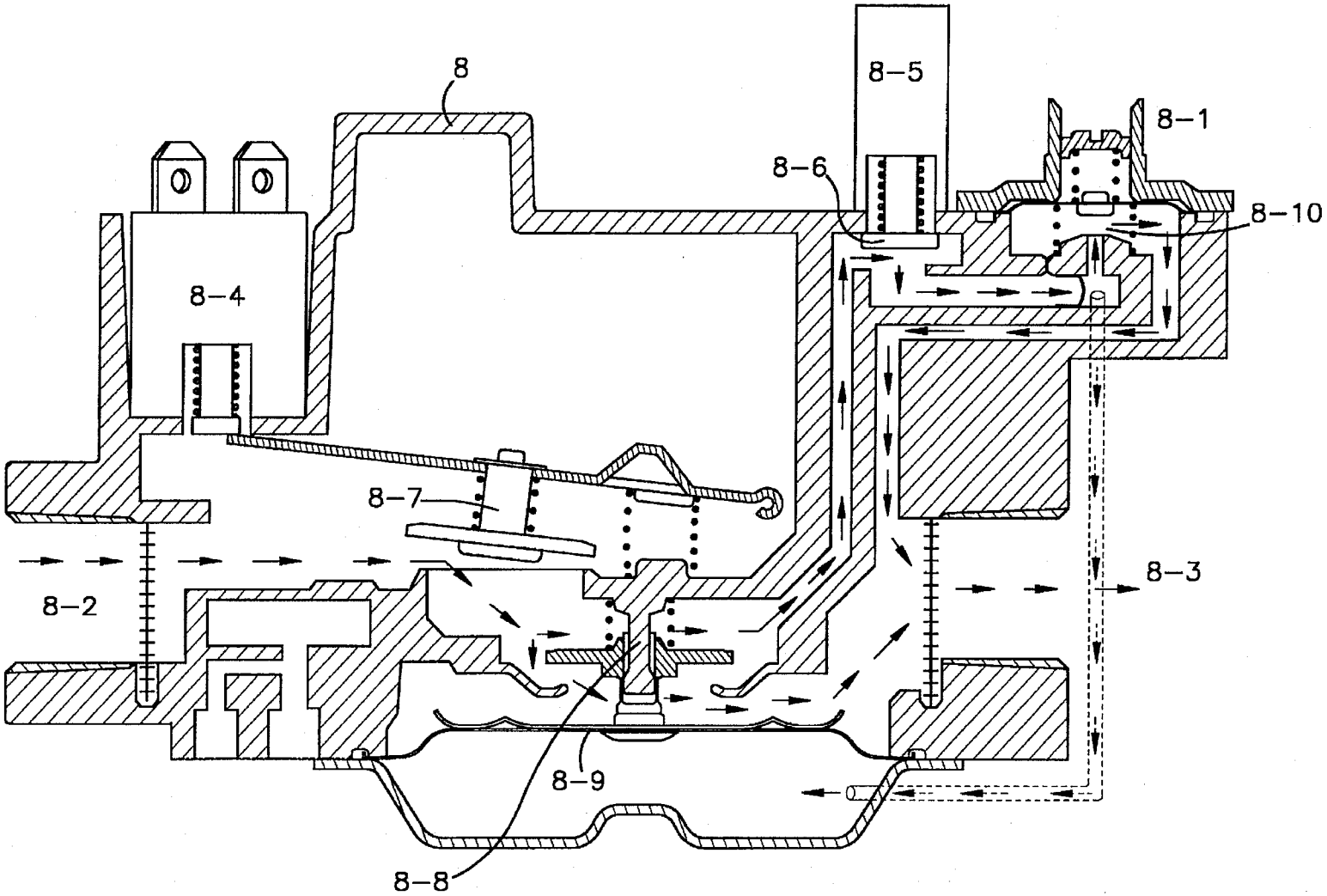
FIG. 3 shows an embodiment of the controllable gas regulator.

An embodiment of the controllable valve 8 shown schematically in FIGS. 1 and 2 can be seen in FIG. 3. The reference signs 8-2 and 8-3 again respectively denote the inlet connection and the outlet connection of the valve. The control connection 8-1 is provided in the form of a servo regulator mechanism and the safety device 8-4 consists of a first automatic actuator. Additionally, the reference sign 8-5 denotes a second automatic actuator, 8-6 a servo-valve, 8-7 a first valve, 8-8 a diaphragm valve and 8-9 a main diaphragm.

Figure 3A:
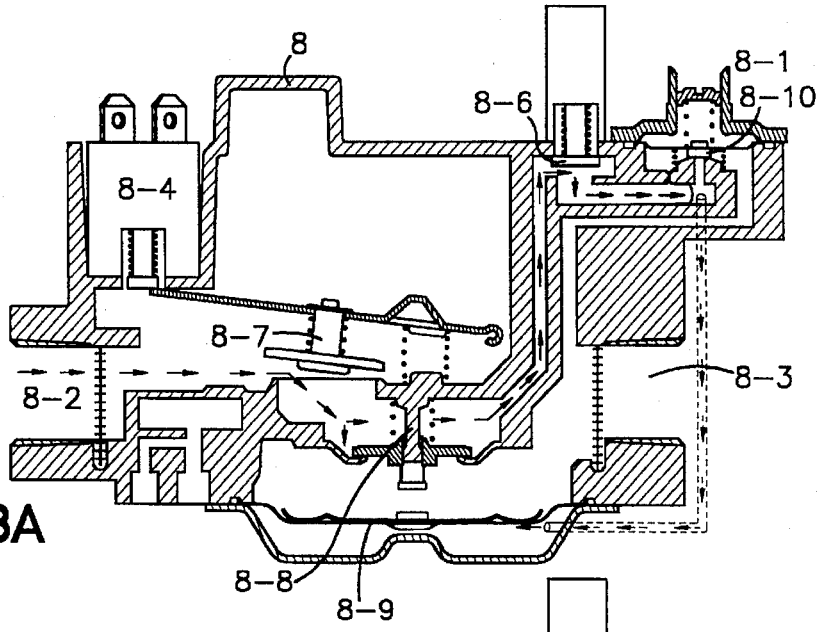
FIGS. 3A, 3B and 3C show operation stages of the controllable gas regulator shown in FIG. 3.
Figure 3B:
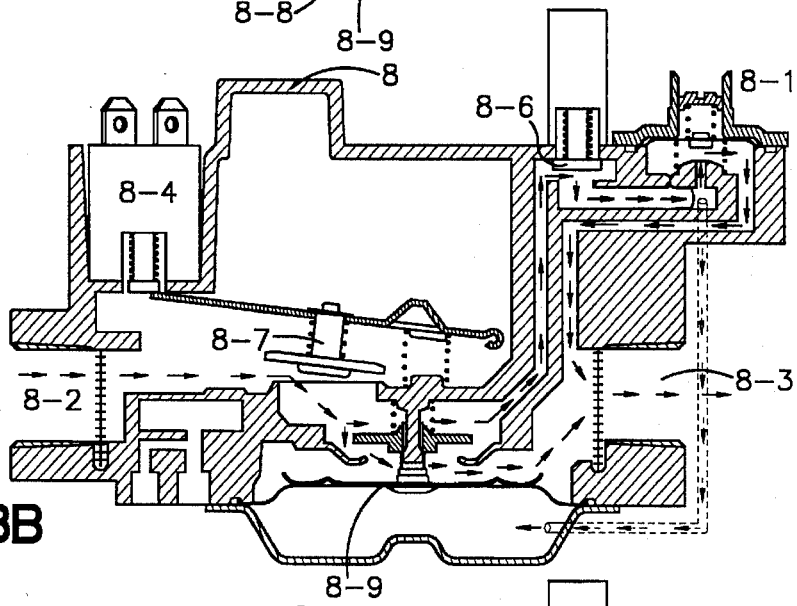
Figure 3C:
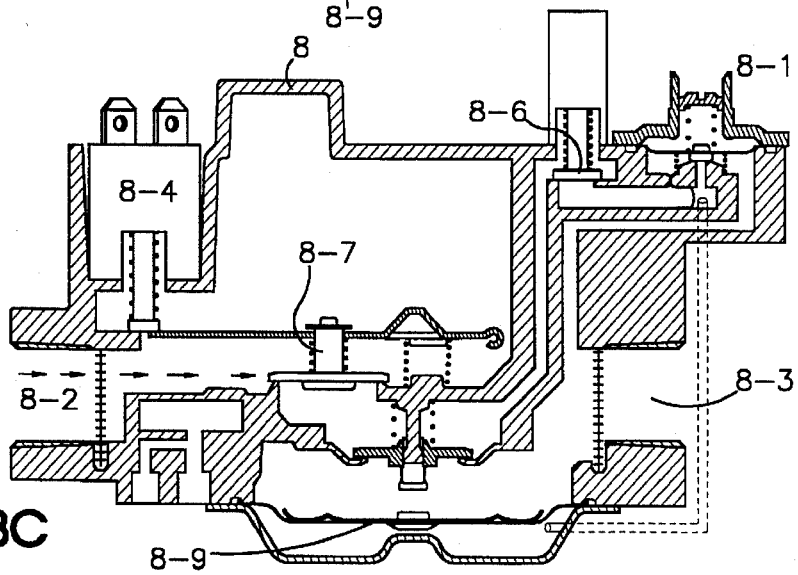
Figure 4:
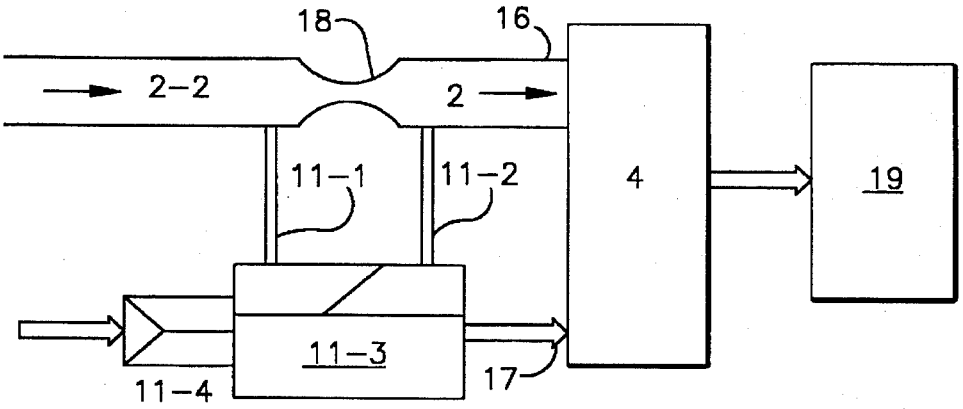
FIG. 4 shows a known fuel/air control system.
Figure 5:
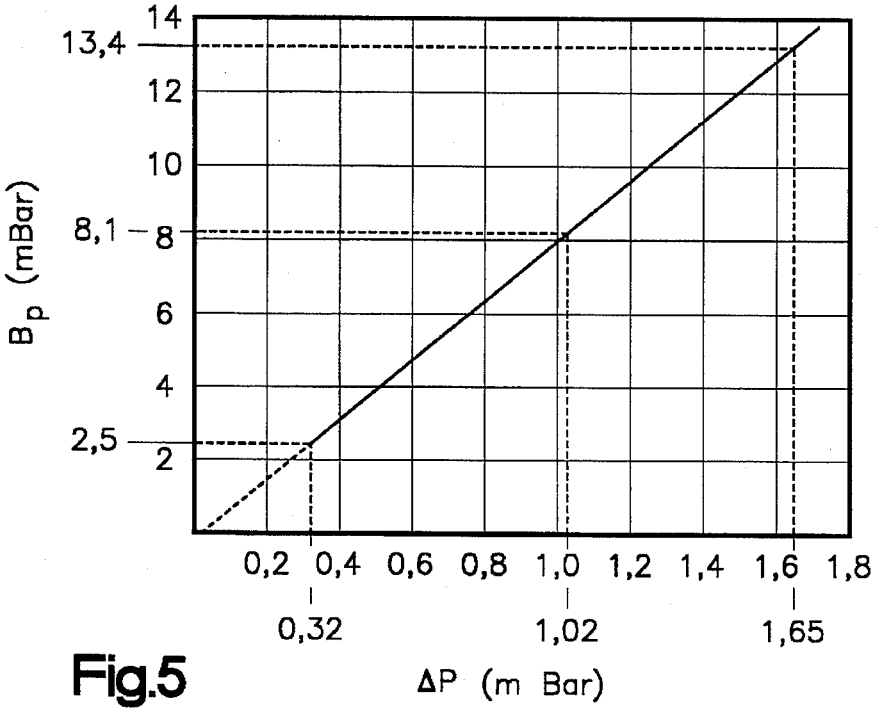
FIG. 5 shows the relationship between the differential pressure and the burner pressure in the known fuel/air control system according to FIG. 4.

The mode of operation of the valve, i.e. the cooperation between the first valve 8-7, the diaphragm valve 8-8 and the servo-valve 8-6 can be seen in FIGS. 3A, 3B and 3C. The servo regulator mechanism 8-1 is provided to maintain a constant burner pressure in case the gas supply pressure at the inlet connection 8-1 fluctuates. For double safety standards, a simultaneous opening and closing of the first and second valves is carried out.

FIG. 3A shows the operating condition of the valve in a lead-up state. In this state, a constant gas pressure acts on the inlet connection 8-3, and the first and second automatic actuators 8-4, 8-5 are simultaneously actuated to open the first valve 8-7 and the servo valve 8-6. Gas from the servo valve flows through an opening to exert a pressure on the main diaphragm 8-9 and to effect an opening of the diaphragm valve 8-8. The servo regulating mechanism 8-1 responds to the outlet pressure in that it opens above pressure. This effects a release of gas from the main diaphragm 8-9 to the gas outlet 8-3 and thus reduces the opening of the diaphragm valve 8-8. The reciprocal effect between the servo regulating mechanism 8-1 and the diaphragm valve 8-8 produces a constant outlet pressure and an even gas flow to the burner 4 is possible (see FIG. 3B for the full operation state).

If there is no voltage across the safety mechanism 8-4, the first valve 8-7, the servo valve 8-6 and the membrane valve 8-8 simultaneously close. Should either the first valve 8-7 and/or the servo valve 8-6 and/or the diaphragm valve 8-8 not close or develop a leakage, an immediate complete interruption of the gas or fuel flow is effected either by the first valve 8-7 or the diaphragm valve 8-8 or the servo valve combination 8-6 (see FIG. 3C for the stand-by condition).

The above operating conditions in FIGS. 3A to 3C are used in the following manner in the regulator in the temperature control apparatus shown in FIG. 2.

The fan 3 exerts a pressure on the air side of the servo regulating mechanism 8-1 via the pressure sensing line 11. On the other hand, the outlet gas 1 exerts a pressure on the gas side of the same servo regulating mechanism 8-1. The diaphragm of the servo regulating mechanism 8-1 is in equilibrium on account of the air pressure and the gas pressure at a ratio of 1:1.

As already explained above, the main diaphragm 8-9 responds as part of the servo regulating system of the control device to an outlet pressure 1 by opening the servo regulating valve 8-10 during regulation. This effects a release of gas from the main diaphragm 8-9 via the servo regulating valve 8-10 and reduces the opening of the diaphragm valve 8-8. The reciprocal effect between the main diaphragm 8-9 and the diaphragm valve 8-8 provides a constant outlet pressure 1 at the gas supply line 17 or at the burner 4. When heating or reduced heating is required, the electronic component of the measuring device 14 controls the supply voltage to the controllable fan 3 proportionally. The fan speed varies accordingly. The modulated air pressure of the air stream 2-2 produced by the fan 3 regulates the outlet fuel pressure 1 via the pressure sensing line 11 and a fuel/air pressure modulation with a ratio of 1:1 is thus obtained. The fuel/air mixture supplied to the burner is modulated via the air restriction 7 and the nozzle 6 by means of the gas volume and the air volume instead of the gas pressure and the air pressure. By using the controllable valve 8 shown in FIG. 3 in the temperature control apparatus shown in FIG. 2, a constant level of harmful substances in the combustion gases is achieved, within a deviation of 1% oxygen in the exhaust gases in a gas/air modulating range of 20% to 100%.

The gas/air ratio control apparatus shown in FIG. 1 not only makes a modulating range of 20% to 100% possible, but also ensures that the control apparatus is driven in a safe condition when faults appear in the control system. Such faults relate to a blockage or leakage in the air inlet, the pressure sensing line and/or the exhaust outlet.

Should for example a leakage occur in the pressure sensing line 11, the fan 3 partially compresses the air side of the regulating diaphragm 8. While the air flow to the burner 4 is maintained unchanged, however, the fuel supply to the burner is reduced on account of which the fuel/air mixture for the burner is adjusted to a lean mixture that burns with excessive air (safe condition).

Should the pressure sensing line 11 be broken, the fan pressure can in no way compress the air-side of the regulating diaphragm 8-1, and even if the pressure sensing line 11 is blocked, the fan pressure 2-2 can not compress the air side of the regulating diaphragm 8-1 in any way. For both a broken or blocked pressure sensing line 11, no fan pressure 2-2 acts on the regulating diaphragm 8-1 so that no fuel pressure 1 and no fuel flow is effected. However, the control apparatus will supply a safe amount of fuel through an internal breather-hole to the burner. This fuel/air mixture is however to poor to form a flame and the flame safety system 5-2, which measures for example the ionization, actuates the safety mechanism 8-4 so that the first valve 8-7, the servo valve 8-6 and the diaphragm valve are closed simultaneously and the control valve 8 goes into the stand-by condition shown in FIG. 3C.

For a blockage in the air inlet 9, the fan pressure 2-2 drops and the fuel pressure 1 thus drops to the same extent. The reduced fuel/air mixture makes it possible to bring the burner into a safe combustion state. If the air inlet is excessively blocked, a monitoring device 5-2 also actuates the safety mechanism 8-4 to produce a safe condition of the control apparatus.

In the case of blockage of the exhaust outlet 10 or dirt in the heat exchanger 5-3, the pressure increases in the burner 4 so that the pressure drop across the nozzle 6 and across the air restriction 7 is the same. The reduced fuel/air mixture makes it possible to operate the burner in a safe condition. Should the exhaust outlet be excessively blocked, the monitoring device 5-2 drives the control valve 8 into its stand-by state on account of poor ionization, i.e. flame formation.

Additionally, the temperature control apparatus shown in FIG. 2 is naturally independent of variations in ambient pressure as the regulating membrane 8-1 is part of a closed loop which is formed by the air-side of the diaphragm 8-1, the pressure sensing line 11, the air supply line 16, the burner 4, the fuel supply line 17 and the fuel-side of the diaphragm 8-1.

A fuel/air modulating range between 20% and 100% is achieved with the above-described temperature control apparatus on account of which the control apparatus is suitable for use in domestic water supply. The control in the control valve 8 takes place at a ratio between the air pressure and the fuel pressure of 1:1. Additionally, only one pressure sensing line 11 is required to control the control valve 8. The control apparatus is always brought into a safe condition when faults or leakages occur in the air or fuel lines.

Contrary to the known systems initially described which operate at an air pressure/fuel pressure ratio of 1:8 and only achieve a modulating range of 45% to 100%, the inventive control apparatus is suitable for the temperature control of hot water in heating water or combi-boilers. Furthermore, the inventive gas/air ratio control apparatus is cheaper.

I claim:

1. Fuel/air ratio control apparatus for controlling operation of a burner of an appliance for heating water, said fuel/air ratio control apparatus comprising:

a) a temperature measuring device for determining an actual temperature of water heated by the appliance and a controllable fan adapted to supply a predetermined air stream that is related to the determined actual temperature of water heated by the appliance;

b) an air supply line adapted to supply the air stream to the burner through a restriction arranged in the air supply line;

c) a fuel supply line adapted to supply fuel to the burner through a nozzle, d) a pressure sensing line adapted to transfer the absolute pressure of the air stream produced by the controllable fan, and e) a pressure-controllable valve connected to the fuel supply line, said pressure-controllable valve including a main diaphragm separating first and second chambers that are sealed from each other, a main valve connected to said main diaphragm adapted to be movable to regulate fuel flow in the first chamber, and a control valve including a control diaphragm adapted to be externally controlled exclusively in response to the absolute pressure transferred by said pressure sensing line, wherein said control valve communicates with said second chamber to enable said main diaphragm to adjust the position of said main valve.

2. The fuel/air ratio control apparatus according to claim 1 wherein the air/fuel mixture applied by the fan and said pressure-controllable valve can be modulated in a range of from 20% to 100%.

3. Fuel/air ratio control apparatus for controlling operation of a burner of an appliance for heating water, said fuel/air ratio control apparatus comprising:

a) a temperature measuring device for determining an actual temperature of water heated by the appliance and a controllable fan adapted to supply a predetermined air stream that is related to the determined actual temperature of water heated by the appliance;

b) an air supply line adapted to supply the air stream to the burner through a restriction arranged in the air supply line;

c) a fuel supply line adapted to supply fuel to the burner through a nozzle, d) a pressure sensing line adapted to transfer the absolute pressure of the air stream produced by the controllable fan, and e) a pressure-controllable valve connected to the fuel supply line and having a fuel outlet connection communicating with said burner, said pressure-controllable valve including a diaphragm separating first and second chambers that are sealed from each other, a main valve connected to said diaphragm adapted to regulate fuel flow in the first chamber, and a control valve adapted to be externally controlled exclusively in response to the absolute pressure transferred by said pressure sensing line, wherein said control valve communicates with said second chamber to enable said diaphragm to adjust the position of the main valve, wherein the air/fuel mixture applied by the fan and said pressure-controllable valve can be modulated in a range of from 20% to 100%.

4. Fuel/air ratio control apparatus for controlling operation of a burner of an appliance for heating water, said fuel/air ratio control apparatus comprising:

a) a temperature measuring device for determining an actual temperature of water heated by the appliance and a controllable fan adapted to supply a predetermined air stream that is related to the determined actual temperature of water heated by the appliance;

b) an air supply line adapted to supply the air stream to the burner through a restriction arranged in the air supply line;

c) a fuel supply line adapted to supply fuel to the burner through a nozzle, d) a pressure sensing line adapted to transfer the absolute pressure of the air stream produced by the controllable fan, and e) a pressure-controllable valve connected to the fuel supply line, said pressure-controllable valve including a diaphragm separating first and second chambers that are sealed from each other, a main valve connected to said diaphragm adapted to regulate fuel flow in the first chamber, and a control valve adapted to be externally controlled exclusively in response to the absolute pressure transferred by said pressure sensing line, wherein said control valve communicates with said second chamber to enable said diaphragm to adjust the position of the main valve, wherein said control valve reduces the fuel pressure at said outlet connection in response to an air pressure drop in said pressure sensing line.

5. The fuel/air ratio control apparatus according to claim 4 wherein said pressure-controllable valve provides fuel at a pressure at said outlet connection that is the same as a control pressure in said air pressure sensing line.

6. Fuel/air ratio control apparatus for controlling operation of a burner of an appliance for heating water, said fuel/air ratio control apparatus comprising:

a) a temperature measuring device for determining an actual temperature of water heated by the appliance and a controllable fan adapted to supply a predetermined air stream that is related to the determined actual temperature of water heated by the appliance;

b) an air supply line adapted to supply the air stream to the burner through a restriction arranged in the air supply line;

c) a fuel supply line adapted to supply fuel to the burner through a nozzle, d) a pressure sensing line adapted to transfer the absolute pressure of the air stream produced by the controllable fan, and e) a pressure-controllable valve connected to the fuel supply line, said pressure-controllable valve including a diaphragm separating first and second chambers that are sealed from each other, a main valve connected to said diaphragm adapted to regulate fuel flow in the first chamber, and a control valve adapted to be externally controlled exclusively in response to the absolute pressure transferred by said pressure sensing line, wherein said control valve communicates with said second chamber to enable said diaphragm to adjust the position of the main valve, wherein the fuel pressure in the fuel supply line has a predetermined value, and a pressure at said outlet connection varies in response to a control pressure in said air pressure sensing line which is the same or smaller than the fuel pressure in the fuel supply line.

7. Fuel/air ratio control apparatus for controlling operation of a burner of an appliance for heating water, said fuel/air ratio control apparatus comprising:

a) a temperature measuring device for determining an actual temperature of water heated by the appliance and a controllable fan adapted to supply a predetermined air stream that is related to the determined actual temperature of water heated by the appliance;

b) an air supply line adapted to supply the air stream to the burner through a restriction arranged in the air supply line;

c) a fuel supply line adapted to supply fuel to the burner through a nozzle, d) a pressure sensing line adapted to transfer the absolute pressure of the air stream produced by the controllable fan, and e) a pressure-controllable valve connected to the fuel supply line, said pressure-controllable valve including a diaphragm separating first and second chambers that are sealed from each other, a main valve connected to said diaphragm adapted to regulate fuel flow in the first chamber, and a control valve adapted to be externally controlled exclusively in response to the absolute pressure transferred by said pressure sensing line, wherein said control valve communicates with said second chamber to enable said diaphragm to adjust the position of the main valve, wherein said pressure-controllable valve has a safety mechanism for closing off fuel flow through said pressure-controllable valve.

8. The fuel/air ratio control apparatus according to claim 7 wherein the safety mechanism is coupled with a monitoring device in the burner.

9. Fuel/air ratio control apparatus for controlling operation of a burner of an appliance for heating water, said fuel/air ratio control apparatus comprising:

a) a temperature measuring device for determining an actual temperature of water heated by the appliance and a controllable fan adapted to supply a predetermined air stream that is related to the determined actual temperature of water heated by the appliance;

b) an air supply line adapted to supply the air stream to the burner through a restriction arranged in the air supply line;

c) a fuel supply line adapted to supply fuel to the burner through a nozzle, d) a pressure sensing line adapted to transfer the absolute pressure of the air stream produced by the controllable fan, and e) a pressure-controllable valve connected to the fuel supply line and having a fuel outlet connection communicating with said burner, said pressure-controllable valve including a diaphragm separating first and second chambers that are sealed from each other, a main valve connected to said diaphragm adapted to regulate fuel flow in the first chamber, and a control valve adapted to be externally controlled exclusively in response to the absolute pressure transferred by said pressure sensing line, wherein said control valve communicates with said second chamber to enable said diaphragm to adjust the position of the main valve, wherein said control valve increases the fuel pressure at said outlet connection in response to an air pressure increase in said pressure sensing line.

10. The fuel/air ratio control apparatus according to claim 9, characterized in that the fuel is gas.

11. The fuel/air ratio control apparatus according to claim 9 wherein the controllable fan is arranged in the air supply line to the burner.

12. The fuel/air ratio control apparatus according to claim 11 wherein the controllable fan is controllable by means of a voltage.

13. The fuel/air ratio control apparatus according to claim 9 wherein a) an inlet connection of the pressure-controllable valve is connected with the fuel supply line which provides fuel at a constant pressure;

b) the outlet connection is connected with the fuel supply line and to the burner; and c) said control valve is connected to the air supply line via said pressure sensing line.

14. The fuel/air ratio control apparatus according to claim 9 wherein said pressure-controllable valve provides fuel at a pressure at said outlet connection that is the same as a control pressure in said air sensing line.

15. The fuel/air ratio control apparatus according to claim 9 wherein the nozzle in the fuel supply line and the restriction in the air supply line are dimensioned in such a manner that the fuel pressure in the fuel supply line and the air pressure in the air supply line are respectively transformed into a specific volume flow.

16. The fuel/air ratio control apparatus according to claim 1 wherein the control apparatus forms a closed loop that includes a) said control valve;

b) said fuel supply line;

c) said nozzle;

d) a burner;

e) said air restriction;

f) said air supply line; and g) said pressure sensing line.

17. The fuel/air ratio control apparatus according to claim 9 wherein the air/fuel mixture applied by the fan and said pressure-controllable valve can be modulated in a range of from 20% to 100%.

* * * * *